US006491069B2

(12) United States Patent
Nagel et al.

(10) Patent No.: US 6,491,069 B2
(45) Date of Patent: Dec. 10, 2002

(54) INTEGRATED VENT AND FLUID TRANSFER FITMENT

(75) Inventors: Phillip Gene Nagel, West Chester, OH (US); James Christopher Bailey, Yellow Springs, OH (US); Gordon Edgar Atkinson, Cedarville, OH (US); Arnold George Benecke, Indian Springs, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/186,085

(22) Filed: Jun. 28, 2002

(65) Prior Publication Data

US 2002/0162602 A1 Nov. 7, 2002

Related U.S. Application Data

(63) Continuation of application No. 09/740,206, filed on Dec. 18, 2000, now Pat. No. 6,427,730, which is a continuation of application No. 09/188,604, filed on Nov. 9, 1998, now Pat. No. 6,206,058.

(51) Int. Cl.[7] ..... B65B 31/00

(52) U.S. Cl. ..... 141/7; 141/4; 141/5; 141/302; 141/309; 141/319; 141/346; 141/349; 141/391; 222/185.1; 222/481

(58) Field of Search ..... 141/2, 4–7, 59, 141/65, 67, 274, 301, 302, 309, 319, 346, 349, 390, 391; 137/212, 854; 251/149.3; 222/185.1, 481, 501; 604/403, 407, 415

(56) References Cited

U.S. PATENT DOCUMENTS

| | | | |
|---|---|---|---|
| 1,715,632 | A | 6/1929 | Wertheimer |
| 2,053,282 | A | 9/1936 | Gewalt |
| 2,061,216 | A | 11/1936 | Thomopson |
| RE20,762 | E | 6/1938 | Thompson |
| 2,137,944 | A | 11/1938 | MacLeod |
| 2,187,671 | A | 1/1940 | Suddarth |
| 2,262,334 | A | 11/1941 | Rugaard |
| D152,616 | S | 2/1949 | Hartley |
| 2,470,837 | A | 5/1949 | Polson |
| 2,566,429 | A | 9/1951 | Schulman |
| 2,618,799 | A | 11/1952 | Barbato |

(List continued on next page.)

FOREIGN PATENT DOCUMENTS

| | | |
|---|---|---|
| CA | 1269210 | 5/1990 |
| CA | 2225303 | 6/1998 |
| WO | WO 99/65819 A2 | 12/1999 |
| WO | WO 01/26531 A2 | 4/2001 |
| WO | WO 01/72195 A1 | 10/2001 |

* cited by examiner

*Primary Examiner*—Timothy L. Maust
(74) *Attorney, Agent, or Firm*—Thibault Fayette; Kim William Zerby; Steven W. Miller

(57) ABSTRACT

A vent and fluid transfer fitment for sealing and transferring a fluid from an inverted fluid-filled container without premature leakage to a receiver attachment, has a transfer check valve and a venting check valve which are preferably duckbill valves. The transfer check valve is attached to the fitment for allowing fluid to be transferred from the container when the receiver attachment engages the transfer check valve. The venting check valve is also attached to the fitment for allowing air to displace the fluid as the fluid exits the container, wherein both the transfer check valve and the venting check valve have an inherent sealing pressure created by the static pressure of the fluid within the container. In addition, the inherent sealing pressure of the venting check valve is less than the inherent sealing pressure of the transfer check valve which allows air to enter the container due to the pressure differential created as the fluid is displaced.

11 Claims, 5 Drawing Sheets

U.S. PATENT DOCUMENTS

| | | | | |
|---|---|---|---|---|
| 2,851,201 | A | 9/1958 | Poitras et al. | 222/481 |
| 3,081,481 | A | 3/1963 | Nohl et al. | |
| 3,094,152 | A | 6/1963 | Kenny et al. | |
| 3,099,028 | A | 7/1963 | Ardito | |
| 3,149,758 | A | 9/1964 | Bush et al. | 222/189 |
| 3,188,669 | A | 6/1965 | Beardslee | |
| 3,278,974 | A | 10/1966 | Nighswander | |
| D207,947 | S | 6/1967 | Johnson et al. | |
| D223,945 | S | 6/1972 | Bousquet | |
| 3,926,339 | A | 12/1975 | Openchowski | |
| 4,119,386 | A | 10/1978 | Cushing | 401/138 |
| 4,130,224 | A | 12/1978 | Norman et al. | 222/185 |
| 4,314,658 | A | 2/1982 | Laaauwe | 222/213 |
| 4,353,488 | A | 10/1982 | Schneiter et al. | |
| 4,533,068 | A | 8/1985 | Meierhoefer | 222/189 |
| 4,646,945 | A | 3/1987 | Steiner et al. | 222/207 |
| 4,646,947 | A | 3/1987 | Stull | 222/397 |
| 4,673,109 | A | 6/1987 | Cassia | 222/153 |
| 4,747,518 | A | 5/1988 | Laauwe | 222/153 |
| 4,765,588 | A | 8/1988 | Atkinson | 251/149.1 |
| 4,776,495 | A | 10/1988 | Vignot | 222/207 |
| 4,846,376 | A | 7/1989 | Palmer | 222/190 |
| 4,863,299 | A | 9/1989 | Osberghaus et al. | 401/15 |
| 4,971,471 | A | 11/1990 | Sloan | 401/203 |
| 5,086,950 | A | 2/1992 | Crossdale et al. | 222/88 |
| 5,092,699 | A | 3/1992 | Silvenis | 401/21 |
| 5,102,010 | A | 4/1992 | Osgar et al. | 222/1 |
| 5,133,482 | A | 7/1992 | Burrows et al. | 222/185 |
| 5,169,035 | A | 12/1992 | Imbery | 222/212 |
| 5,244,124 | A | 9/1993 | Raffo | 222/325 |
| 5,251,873 | A | 10/1993 | Atkinson et al. | 251/149.1 |
| 5,295,657 | A | 3/1994 | Atkinson | 251/149.1 |
| 5,295,658 | A | 3/1994 | Atkinson et al. | 251/149.1 |
| 5,402,982 | A | 4/1995 | Atkinson et al. | 251/149.1 |
| D358,238 | S | 5/1995 | Barnett | D32/50 |
| 5,431,205 | A | 7/1995 | Gebhard | 141/351 |
| 5,433,353 | A | 7/1995 | Flinn | 222/481 |
| 5,472,122 | A | 12/1995 | Appleby | 222/212 |
| 5,494,074 | A | 2/1996 | Ramacier, Jr. et al. | 737/614.04 |
| 5,501,426 | A | 3/1996 | Atkinson et al. | 251/149.1 |
| 5,533,708 | A | 7/1996 | Atkinson et al. | 251/149.1 |
| 5,577,638 | A | 11/1996 | Takagawa | 222/185.1 |
| 5,636,402 | A | 6/1997 | Kubo et al. | 15/98 |
| 5,735,959 | A | 4/1998 | Kubo et al. | 118/663 |
| D396,908 | S | 8/1998 | Beechuk et al. | D32/45 |
| D401,703 | S | 11/1998 | Beechuk et al. | D32/45 |
| 5,888,006 | A | 3/1999 | Ping et al. | 401/137 |
| 6,427,730 | B2 * | 8/2002 | Nagel et al. | 141/302 |

* cited by examiner

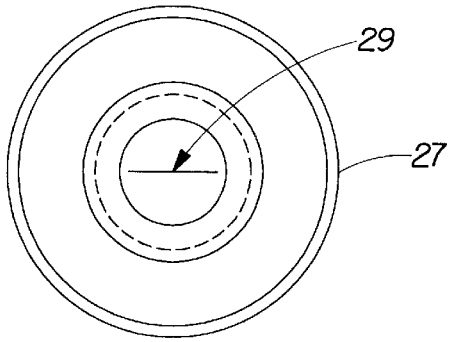
Fig. 3a
Fig. 3b
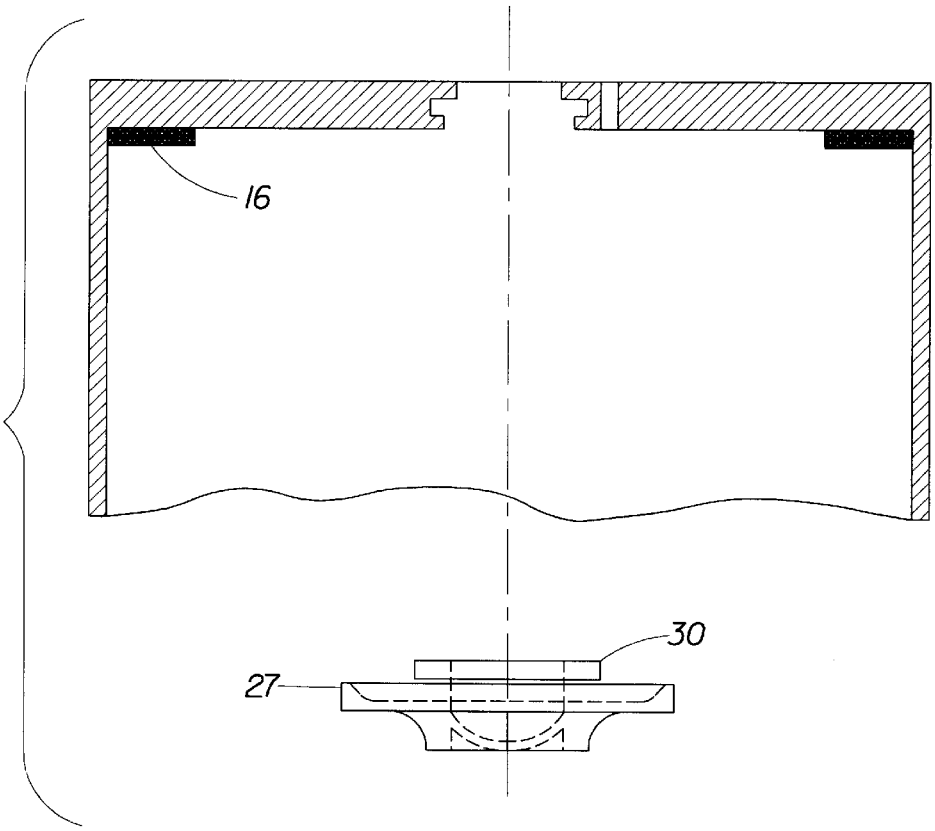

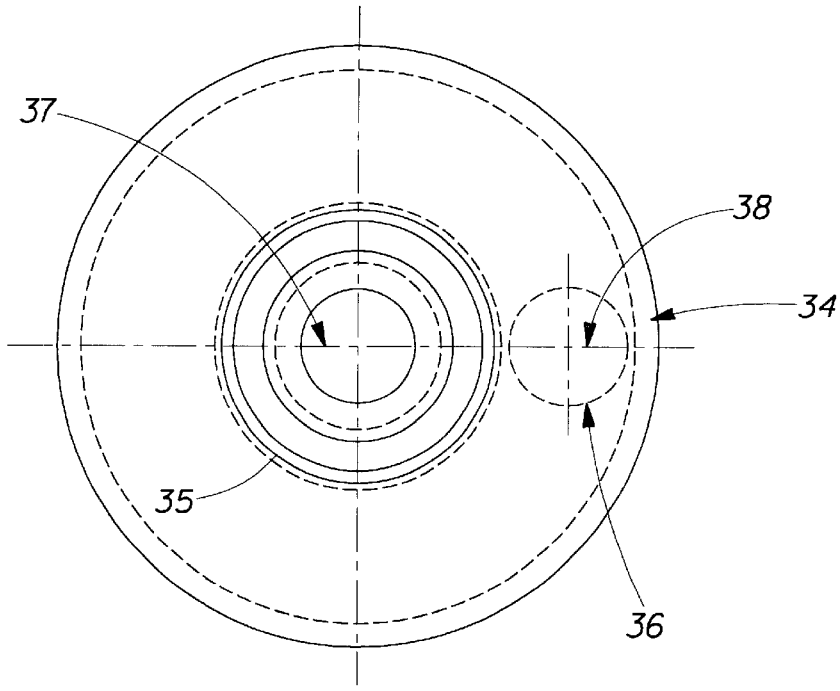
Fig. 4a
Fig. 4b
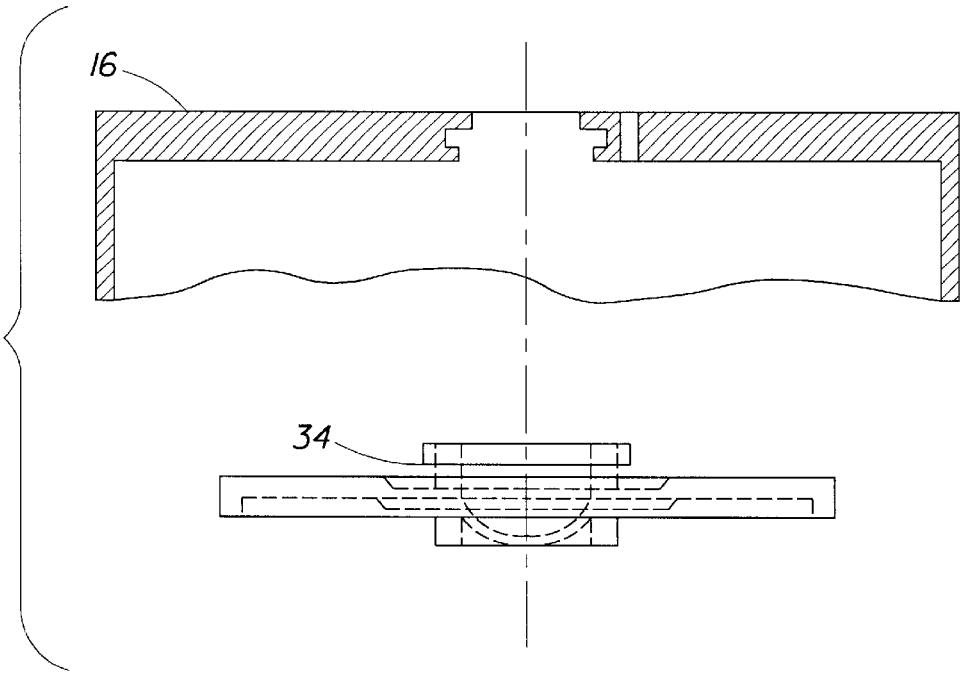

INTEGRATED VENT AND FLUID TRANSFER FITMENT

CROSS REFERENCE TO RELATED APPLICATIONS

This application is a Continuation of U.S. application Ser. No. 09/740,206 filed Dec. 18, 2000 (Attorney Docket No. 7337C)now U.S. Pat. No. 6,427,730, which is a Continuation of U.S. application No. 09/188,604 filed Nov. 9, 1998 (Attorney Docket No. 7337)now U.S. Pat. No. 6,206,058.

FIELD OF THE INVENTION

The present invention relates to an improved vent and fluid transfer fitment, and more particularly, to a vent and fluid transfer fitment for a fluid-filled container that allows the contents of the container to be vented while being transferred without the contents spilling when the container is inverted.

BACKGROUND OF THE INVENTION

Conventional vent and fluid transfer systems utilize a non-inverted container having a dip tube for transferring fluid from the container. The container is typically vented using a hole in the top of the container. However, the fluid within these systems leak when the container is in an inverted orientation.

Another approach has been to use vented trigger sprayers to dispense fluids from a container. These systems typically use a switch mechanism to close the vent except when the unit is dispensing. However, leakage can occur if the unit is actuated when the container is in a sideways or inverted orientation.

A third approach has been to provide a container with walls that are sufficiently thin such that they collapse under the vacuum pressure created by the removal of the container's contents. This type of system eliminates the need to allow air into the container to displace the fluid that is dispensed from the container. However, the system does not allow a steady fluid flow from the container as the fluid flow will decrease as the vacuum pressure within the container increases.

Therefore, what is needed is an improved vent and fluid transfer fitment that allows fluid to be uniformly transferred from an inverted container without leaking and which vents the container such that the displaced fluid is replaced by air.

SUMMARY OF THE INVENTION

It is an object of the present invention to provide an improved vent and fluid transfer fitment.

It is a further object of the present invention to provide a vent and fluid transfer fitment for sealing and transferring a fluid from an inverted fluid-filled container without premature leakage to a receiver attachment, comprising a transfer check valve attached to the fitment for allowing fluid to be transferred from the container when the receiver attachment engages the transfer check valve, and a venting check valve attached to the fitment for allowing air to displace the fluid as the fluid exits the container, wherein both the transfer check valve and the venting check valve have an inherent sealing pressure created by the static pressure of the fluid within the container.

BRIEF DESCRIPTION OF THE DRAWINGS

FIG. 3*a* is a top view of a first alternate vent and fluid transfer fitment according to the present invention.

FIG. 3*b* is a side assembly drawing of a septum valve of the first alternate vent and fluid transfer fitment in relation to a container according to the present invention.

FIG. 4*a* is a top view of a dual slit valve of the second alternate vent and fluid transfer fitment according to the present invention.

FIG. 4*b* is a side assembly drawing of a dual slit valve of the second alternate vent and fluid transfer fitment in relation to a container according to the present invention.

DETAILED DESCRIPTION OF THE INVENTION

Figure 1A:
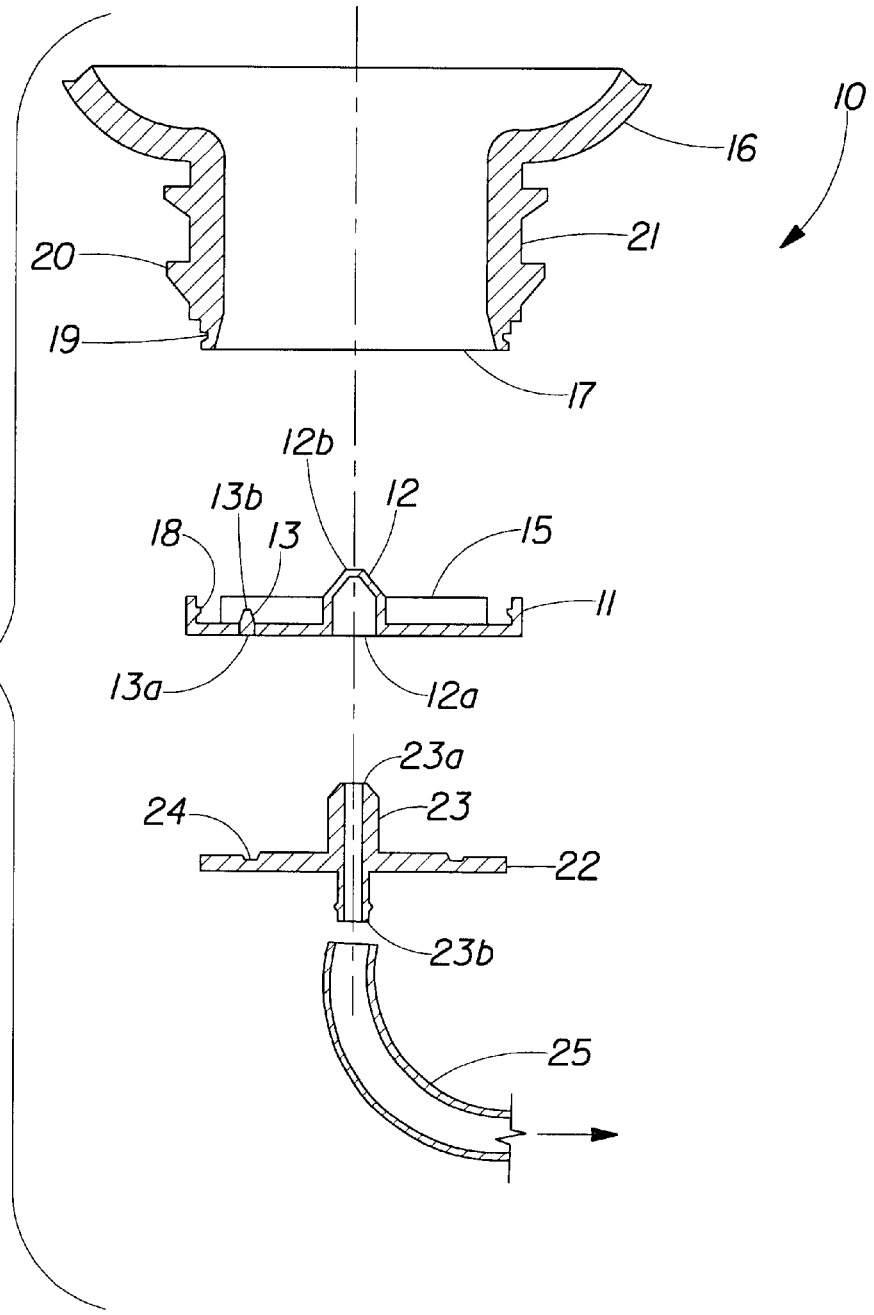
FIG. 1*a* is a cross-sectional assembly drawing of the preferred vent and fluid transfer fitment in relation to a container and a receiver attachment according to the preferred embodiment of the present invention.
Figure 1B:
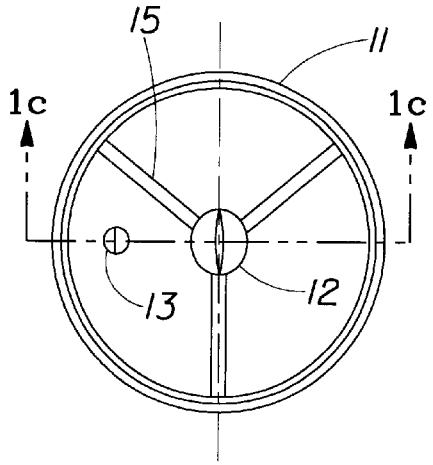
FIG. 1*b* is a top view of the preferred vent and fluid transfer fitment according to the present invention.
Figure 1C:
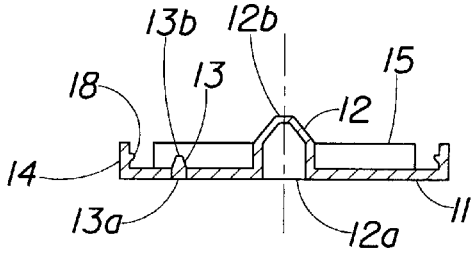
FIG. 1*c* is a cross-sectional view of an alternate vent and fluid transfer fitment according to the present invention.
Figure 2:
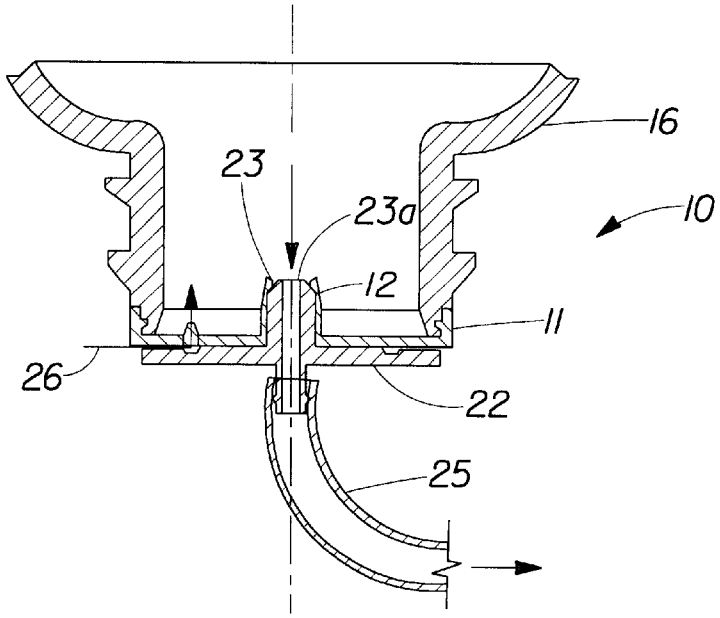
FIG. 2 is a cross-sectional view of the preferred vent and fluid transfer fitment, as assembled, in relation to the container and the receiver attachment according to the present invention.

Referring to FIGS. 1 and 2, the preferred vent and fluid transfer fitment 10 comprises a transfer fitment 11 having a transfer check valve 12 and a venting check valve 13 and is shown in an unassembled (FIG. 1) and an assembled (FIG. 2) configuration. The transfer fitment 11 is preferably a single molded part that contains both the transfer check valve 12 and the venting check valve 13 (FIGS. 1*a* and 1*b*). However, the fitment 11 may include a cap or closure 14 in which a separate transfer check valve 12 and venting check valve 13 are inserted (FIG. 1*c*) without deviating from the intent of the invention.

In addition, the preferred transfer fitment 11 may have support ribs 15 which add stability to the transfer fitment 11 and particularly to the transfer check valve 12 as shown in FIGS. 1*a* and 1*b*. The transfer check valve 12 and the venting check valve 13 are preferably duckbill valves which have an inherent sealing pressure and which are oriented in the same direction. However, the valves 12 and 13 may comprise a variety of valves without deviating from the intent of the invention. For example, the check valves 12 and 13 may comprise umbrella valves, ball and spring check valves or a slit valve. In addition, the venting check valve 13 may be located elsewhere on the bottle 16 and/or in a different orientation without deviating from the intent of the invention. The fitment 11, the transfer check valve 12, and the venting check valve 13 preferably comprise an elastomeric material.

The preferred transfer duckbill valve 12 has an open end 12*a* and a closed "beak" end 12*b* which remains in a closed position when the transfer duckbill valve 12 is in the relaxed state (FIG. 1*a*). The preferred venting duckbill valve 13 also has an open end 13*a* and a closed "beak" end 13*b* which remains in a closed position when the venting duckbill valve 12 is in the relaxed state (FIG. 1*a*).

The preferred fitment 11 is attached to a fluid filled bottle 16, specifically an opening 17, by snapping a snap bead 18 of the fitment 11 into a snap rim 19 of the bottle 16. However, the fitment 11 may be attached to the bottle 16 using screw threads 20 on a bottle finish 21 as is well known in the art. After attaching the preferred fitment 11 to the bottle 16, the bottle 16 may be inverted without allowing the contents of the fluid within the bottle 16 to exit due to the valves 12 and 13 being in the relaxed state as seen in FIG. 1*a* and the ends 12*b* and 13*b* remaining closed.

The preferred fitment 11 and bottle 16 assembly is connected to a receiver attachment 22 which has a probe tip 23 and an air vent groove 24. The probe tip 23 has a first and second open end 23*a* and 23*b,* respectively. The first open end 23*a* of the probe tip 23 deforms and opens the "beak" end 12*b* of the transfer duckbill valve 12 upon insertion into the open end 12*a* (FIG. 2). The second open end 23*b* of the probe 23 is preferably connected to a tube 25 for guiding the fluid from the bottle 16 to a pump or reservoir (not shown). However, the tube 25 and receiver attachment 22 may be formed as a single piece without deviating from the intent of the invention.

When the bottle 16 is in an inverted orientation (FIG. 1*a*), the internal static pressure acting against the "beak" end 12*b* and 13*b* of the duckbill valves 12 and 13, respectively, will seal the valves 12 and 13 tightly. Therefore, the valves 12 and 13 prevent fluid from prematurely flowing out of the inverted bottle 16 until the probe 23 of the receiver attachment 22 in inserted within the transfer duckbill valve 12.

Upon insertion of the receiver attachment's probe 23 into the transfer duckbill valve 12, the fluid is transferred by gravity through the probe tip 23 as it deforms and opens the transfer duckbill valve 12. As a result, a vacuum (sub-atmospheric) pressure is created within the bottle 16. When the vacuum is sufficient to overcome the sealing pressure on the venting valve 13, a bubble of air will be drawn into the bottle 16 along an air flow path 26 (FIG. 2) which quickly relieves the vacuum pressure created within the bottle 16 by the fluid exiting and resumes the sealing pressure. Preferably, the sealing pressure of the venting duckbill valve 13 is less than the sealing pressure of the transfer duckbill valve 12. As a result, the vacuum (sub-atmospheric) pressure created within the bottle 16 will cause the venting duckbill valve 13 to open and not the transfer duckbill valve 12 beyond the opening created by the displacement of the valve 12 due to the probe 23.

The air vent groove 24 in the receiver attachment 22 ensures that air can reach the venting duckbill valve 13 and be drawn into the bottle 16 when sufficient sub-atmospheric pressure is generated by the transfer of the fluid from the bottle 16. As the probe tip 23 is pushed through the transfer duckbill valve 12 (FIG. 2), the probe 23 seals along the inside wall of the duckbill valve 12. In the fully seated position (FIG. 2), the probe 23 extends through the open end 12*a* of the duckbill valve 12 and provides a fluid path to the tube 25.

Figure 3C:
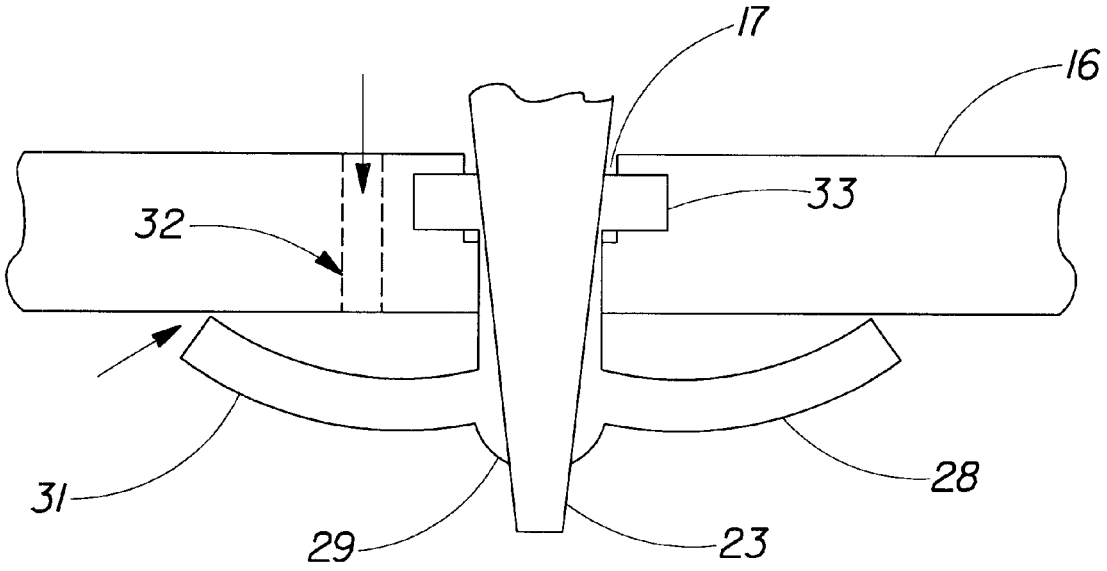
FIG. 3*c* is a cross-sectional view of an umbrella valve of the first alternate vent and fluid transfer fitment according to the present invention.

Referring to FIGS. 3*a*–3*c,* the first alternate vent and fluid transfer fitment preferably comprises the transfer fitment 11 having a transfer check valve 27 (FIGS. 3*a* and 3*b*) and a venting check valve 28. The alternate transfer check valve 27 is preferably a septum valve and the alternate venting check valve 28 is preferably an umbrella valve, both of which have an inherent sealing pressure and which are oriented in the same direction. As in the preferred embodiment, the alternate venting check valve 28 may be located elsewhere on the bottle 16 and/or in a different orientation without deviating from the intent of the invention. The septum valve 27 is attached to the container 16 using a fitment 30.

In addition, the septum valve 27 and the umbrella valve 28 may be formed from a single piece as shown in FIG. 3*c*. In this way, the probe 23 is inserted through a slit 29 in the umbrella valve 28. The umbrella valve 28 has an umbrella portion 31 which sealingly covers an air vent 32. The umbrella valve 28 is attached to the bottle 16 using a fitment 33. The septum valve 27 seals the opening 17 of the bottle 16 when the bottle 16 is inverted. The slit 29 allows the probe 23 to be inserted within the septum valve 27 for the transfer of the contents within the bottle 16. When the pressure builds sufficiently within the bottle 16, the inherent sealing pressure of the umbrella valve 28, specifically the umbrella portion 31, will release and air will be drawn within the bottle 16 until the pressure differential is equalized.

Referring to FIGS. 5 and 6, the second alternate vent and fluid transfer fitment 34 preferably comprises the transfer fitment 11 having a dual slit transfer check valve 35 and venting check valve 36. Both the alternate transfer check valve 35 and the alternate venting check valve 36 are preferably slit valves having slits 37 and 38, respectively. In addition, both the transfer slit valve 35 and the venting slit valve 36 have an inherent sealing pressure and are oriented in the same direction.

In operation, the probe 23 is inserted within the slit 37 of the transfer slit valve 35. When the vacuum pressure within the bottle 16 is sufficient to overcome the inherent sealing pressure of the venting slit valve 36, the slit 38 of the venting slit valve 36 will open and allow air to be drawn within the bottle 16 until the pressure differential is equalized. As in the preferred embodiment, the alternate venting check valve 36 may be located elsewhere on the bottle 16 and/or in a different orientation without deviating from the intent of the invention.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A vent and fluid transfer assembly for transferring a fluid from an inverted fluid-filled bottle comprising:

a fluid filled bottle having an opening;

a fitment removably attached to said opening of said bottle, said fitment having a vent opening and a fluid transfer opening;

a venting check valve attached to said fitment, said venting check valve having an inherent sealing pressure wherein said venting check valve is in fluid communication with said vent opening; and a spring-loaded fluid transfer check valve attached to said fitment, said spring-loaded fluid transfer check valve having an inherent sealing pressure and wherein said spring-loaded fluid transfer check valve is in fluid communication with said fluid transfer opening, said spring-loaded fluid transfer check valve comprising a probe having a first and a second opening such that when said bottle is inverted, said fluid does not flow through said probe when said probe is in a first position and said fluid flows by gravity from said first opening to said second opening within said probe when said probe is in a second position.

2. The vent and fluid transfer assembly of claim 1 wherein said venting check valve is a duckbill valve.

3. The vent and fluid transfer assembly of claim 2 wherein the inherent sealing pressure of said duckbill valve is less than the inherent sealing pressure of said spring-loaded fluid transfer check valve such that venting occurs in said bottle when said probe is in said second position and said fluid flows by gravity.

4. The vent and fluid transfer assembly of claim 1 wherein said spring-loaded fluid transfer check valve comprises an elastomeric material.

5. The vent and fluid transfer assembly of claim 1 wherein said bottle comprises a finish having screw threads and said fitment is threadably attachable to said finish.

6. The vent and fluid transfer assembly of claim 2 wherein said duckbill valve comprises an open end and a closed beak end wherein said closed beak end remains in a closed position when said duckbill valve is in a relaxed state.

7. A method of transferring a fluid from a fluid container, said method comprising the steps of:

providing a container filled with a fluid, said container having an opening;

attaching a fluid transfer device to said opening of said container, said fluid transfer device comprising:

a fitment removably attached to said opening of said container, said fitment having a vent opening and a fluid transfer opening;

a venting check valve attached to said fitment, said venting check valve having an inherent scaling pressure and wherein said venting check valve is in fluid communication with said vent opening; and a spring-loaded fluid transfer check valve attached to said fitment, said spring-loaded fluid transfer check valve having an inherent sealing pressure and wherein said spring-loaded fluid transfer check valve is in fluid communication with said fluid transfer opening, said spring-loaded fluid transfer check valve comprising a probe having a first and a second opening such that when said container is inverted, said fluid does not flow through said probe when said probe is in a first position and said fluid flows by gravity from said first opening to said second opening within said probe when said probe is in a second position; and a tube attached to said second opening of said probe;

inverting said container; and pushing said probe from said first position to said second position such that fluid flows from said container by gravity and venting occurs in the container through said venting check valve.

8. The method of claim 7 wherein said venting check valve is a duckbill valve.

9. The method of claim 7 wherein said spring-loaded fluid transfer check valve comprises an elastomeric material.

10. The method of claim 7 wherein said container comprises a finish having screw threads and said fitment is threadably attachable to said finish.

11. The method of claim 7 wherein said duckbill valve comprises an open end and a closed beak end wherein said closed beak end remains in a closed position when said duckbill valve is in a relaxed state.

* * * * *